US009173456B2

(12) United States Patent
Kohlndorfer

(10) Patent No.: US 9,173,456 B2
(45) Date of Patent: Nov. 3, 2015

(54) LIGHT WEIGHT TWO-POINT AVIATION SEATBELT

(75) Inventor: Kenneth H. Kohlndorfer, Roseville, MI (US)

(73) Assignee: AUTOLIV ASP, INC., Ogden, UT (US)

( * ) Notice: Subject to any disclaimer, the term of this patent is extended or adjusted under 35 U.S.C. 154(b) by 404 days.

(21) Appl. No.: 13/464,118

(22) Filed: May 4, 2012

(65) Prior Publication Data

US 2013/0292990 A1 Nov. 7, 2013

(51) Int. Cl.
*B60R 22/00* (2006.01)
*A44B 11/25* (2006.01)

(52) U.S. Cl.
CPC ..... *A44B 11/2526* (2013.01)

(58) Field of Classification Search
CPC ..... A44B 11/2511; A44B 11/2526; A44B 11/2523; A44B 11/2576; A44B 11/2557; B64D 25/06
USPC ..... 24/572.1, 171, 196, 638, 637, DIG. 30, 24/DIG. 51, DIG. 52, 631, 633, 630; 280/801.1
See application file for complete search history.

(56) References Cited

U.S. PATENT DOCUMENTS

| | | | | | |
|---|---|---|---|---|---|
| 2,869,200 | A * | 1/1959 | Phillips et al. | ..... | 24/638 |
| 3,179,992 | A * | 4/1965 | Murphy, Sr. | ..... | 24/638 |
| 3,287,775 | A * | 11/1966 | Eubank | ..... | 24/637 |
| 3,576,056 | A * | 4/1971 | Barcus | ..... | 24/638 |
| 3,760,464 | A * | 9/1973 | Higuchi | ..... | 24/323 |
| 5,088,160 | A | 2/1992 | Warrick | | |
| 5,311,653 | A * | 5/1994 | Merrick | ..... | 24/196 |
| 6,442,807 | B1 * | 9/2002 | Adkisson | ..... | 24/633 |
| 6,588,077 | B2 * | 7/2003 | Katsuyama et al. | ..... | 24/641 |
| 7,904,997 | B2 * | 3/2011 | Foubert | ..... | 24/631 |

* cited by examiner

*Primary Examiner* — Robert J Sandy
*Assistant Examiner* — Rowland Do
(74) *Attorney, Agent, or Firm* — Harness, Dickey & Pierce, P.L.C.

(57) ABSTRACT

A restraint system for a mobile platform is provided and may include a first belt portion and a second belt portion each having a first end secured to the mobile platform and a second end movable relative to the mobile platform. A latch plate may be fixed to the second end of one of the first belt portion and the second belt portion and a buckle may be secured to the second end of the other of the first belt portion and the second belt portion. The buckle may be selectively connected to the latch plate in a latched state and may include a housing having an opening receiving the latch plate in the latched state and at least one aperture disposed adjacent to the opening and formed through a surface of the housing opposing a user when in the latched state.

16 Claims, 11 Drawing Sheets

LIGHT WEIGHT TWO-POINT AVIATION SEATBELT

FIELD

The present disclosure relates to a restraint system and more particularly to a light-weight restraint system for a mobile platform.

BACKGROUND

This section provides background information related to the present disclosure which is not necessarily prior art.

Restraint systems are typically used in mobile platforms such as automobiles, trains, and aircraft to secure occupants during movement of the mobile platform. For example, automobiles typically include integrated lap and shoulder belts that secure an occupant relative to a seat of the automobile, thereby restricting movement of the occupants relative to the seat should the automobile experience an impact event. Likewise, aircraft typically incorporate lap belts that secure an occupant relative to a seat during flight to restrict movement of the occupant relative to the seat should the aircraft experience turbulence.

The primary concern when designing any of the foregoing restraint systems is occupant safety. However, other factors are considered depending on the needs and function of the particular mobile platform for which the restraint system is designed. For example, automotive restraint systems are typically designed to be aesthetically pleasing, light-weight, easy to use, and compact. Likewise, aircraft restraint systems or restraint systems designed for mass transit such as busses and trains are designed to be light-weight and easy to use but are not typically designed to be aesthetically pleasing or compact.

The common design considerations amongst the various types of restraint systems are safety, ease of use, and weight. While safety is chief amongst the foregoing considerations, weight is becoming increasingly more important in the face of rising fuel prices and material costs.

Heavier mobile platforms require more energy to travel from one destination to another when compared to lighter mobile platforms. As a result, heavier mobile platforms consume more fuel than lighter mobile platforms and are more costly to operate. Engineers therefore strive to reduce the weight of virtually every component of a mobile platform—restraint systems included—in an effort to reduce manufacturing cost and complexity and to the reduce fuel costs of the end user.

SUMMARY

This section provides a general summary of the disclosure, and is not a comprehensive disclosure of its full scope or all of its features.

A restraint system for a mobile platform is provided and may include a first belt portion and a second belt portion each having a first end secured to the mobile platform and a second end movable relative to the mobile platform. A latch plate may be fixed to the second end of one of the first belt portion and the second belt portion and a buckle may be secured to the second end of the other of the first belt portion and the second belt portion. The buckle may be selectively connected to the latch plate in a latched state to join the first belt portion and the second belt portion and may include a housing having an opening receiving the latch plate in the latched state and at least one aperture disposed adjacent to the opening and formed through a surface of the housing opposing a user when in the latched state.

A restraint system for a mobile platform is provided and may further include a first belt portion having a first end secured to the mobile platform and a second end movable relative to the mobile platform. A second belt portion may include a first end secured to the mobile platform and a second end movable relative to the mobile platform. A buckle may be secured to the second end of one of the first belt portion and the second belt portion and may include a latch mechanism movable between a latched state and an unlatched state. A latch plate may be fixed to the second end of the other of the first belt portion and the second belt portion and may be selectively received within the buckle in the latched state to join the first belt portion and the second belt portion. The latch plate may include an aperture that engages the latch mechanism in the latched state and may have a longitudinal axis that is parallel to a longitudinal axis of the latch plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings

DETAILED DESCRIPTION

Figure 1:
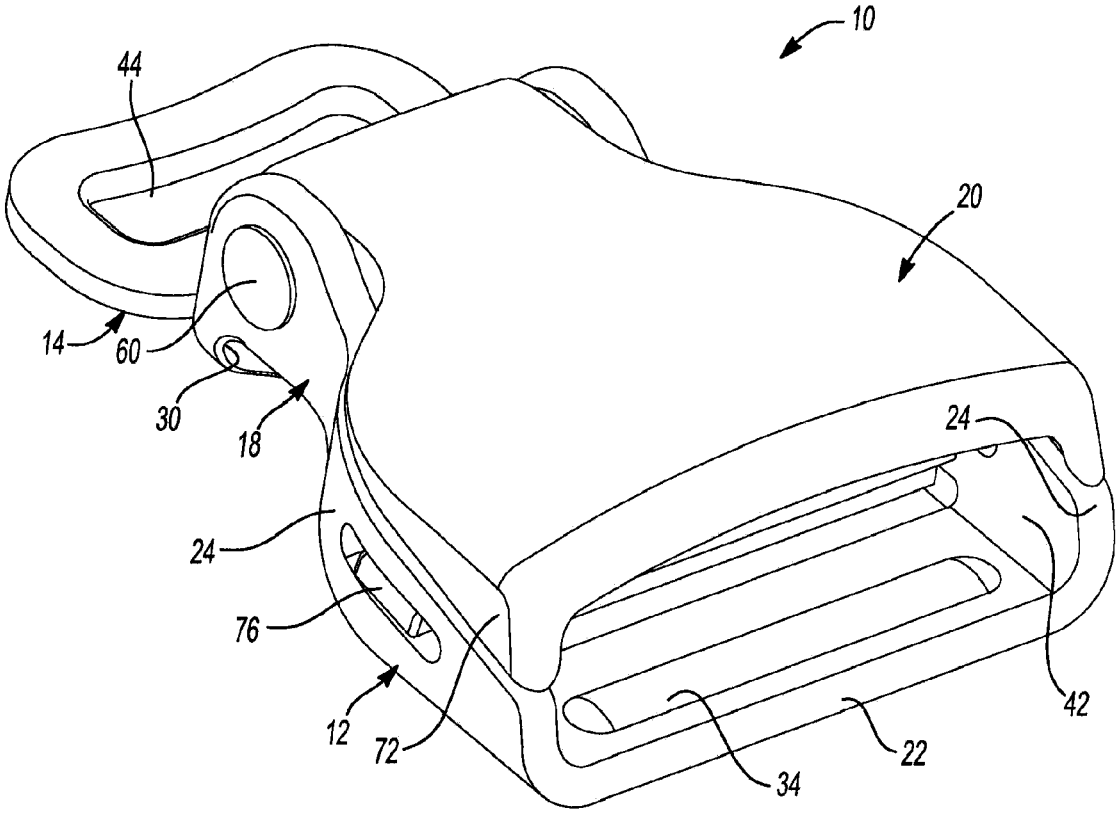
FIG. 1 is a perspective view of a restraint device in accordance with the principles of the present disclosure shown in a latched state.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a restraint device 10 is provided and may include a buckle 12, a latch plate 14, and a locking mechanism 16. The locking mechanism 16 may be supported by the buckle 12 and may selectively engage the latch plate 14 to connect the latch plate 14 to the buckle 12. Namely, the locking mechanism 16 may be moved between a latched state (FIG. 1) connecting the latch plate 14 to the buckle 12 and an unlatched state that allows the latch plate 14 to be disconnected from the buckle 12.

The buckle 12 may include a housing 18 and an actuation handle 20. The actuation handle 20 may be pivotably supported by the housing 18 to selectively move the locking mechanism 16 from the latched state to the unlatched state.

The housing 18 may include a bottom wall 22 and a pair of side walls 24 that are formed integrally with the bottom wall 22 and extend substantially perpendicular to the bottom wall 22. The bottom wall 22 may include a belt aperture 26, an intermediate aperture 28, a pair of apertures 30 disposed proximate to an opening 32 of the housing 18, and a rib 34.

Figure 3:
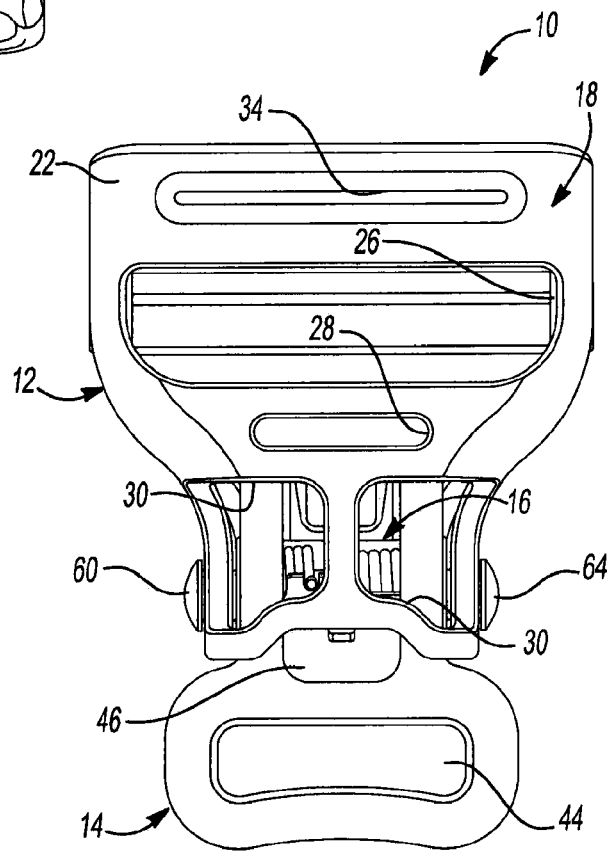
FIG. 3 is a bottom view of the restraint device of FIG. 1.
Figure 4:
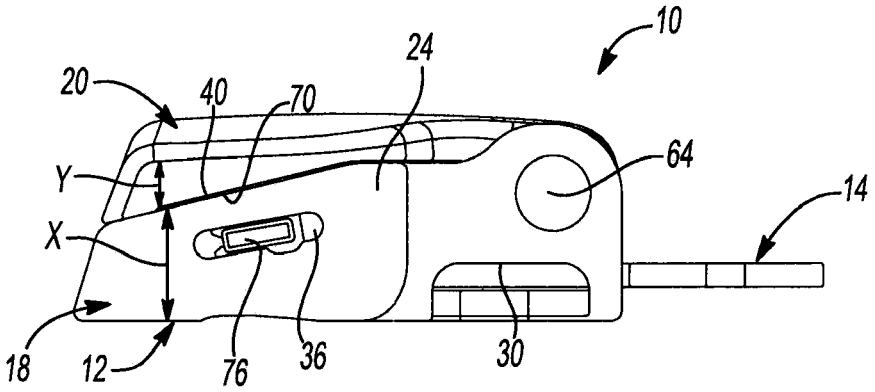
FIG. 4 is a right side view of the restraint device of FIG. 1.
Figure 5:
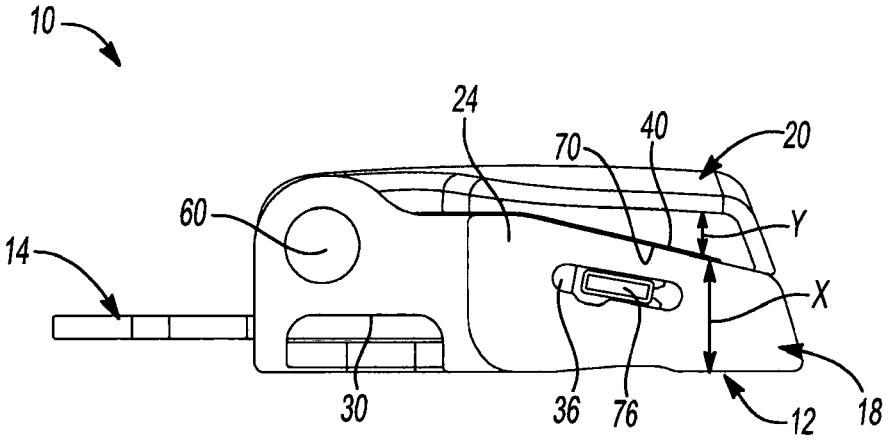
FIG. 5 is a left side view of the restraint device of FIG. 1.
Figure 6:
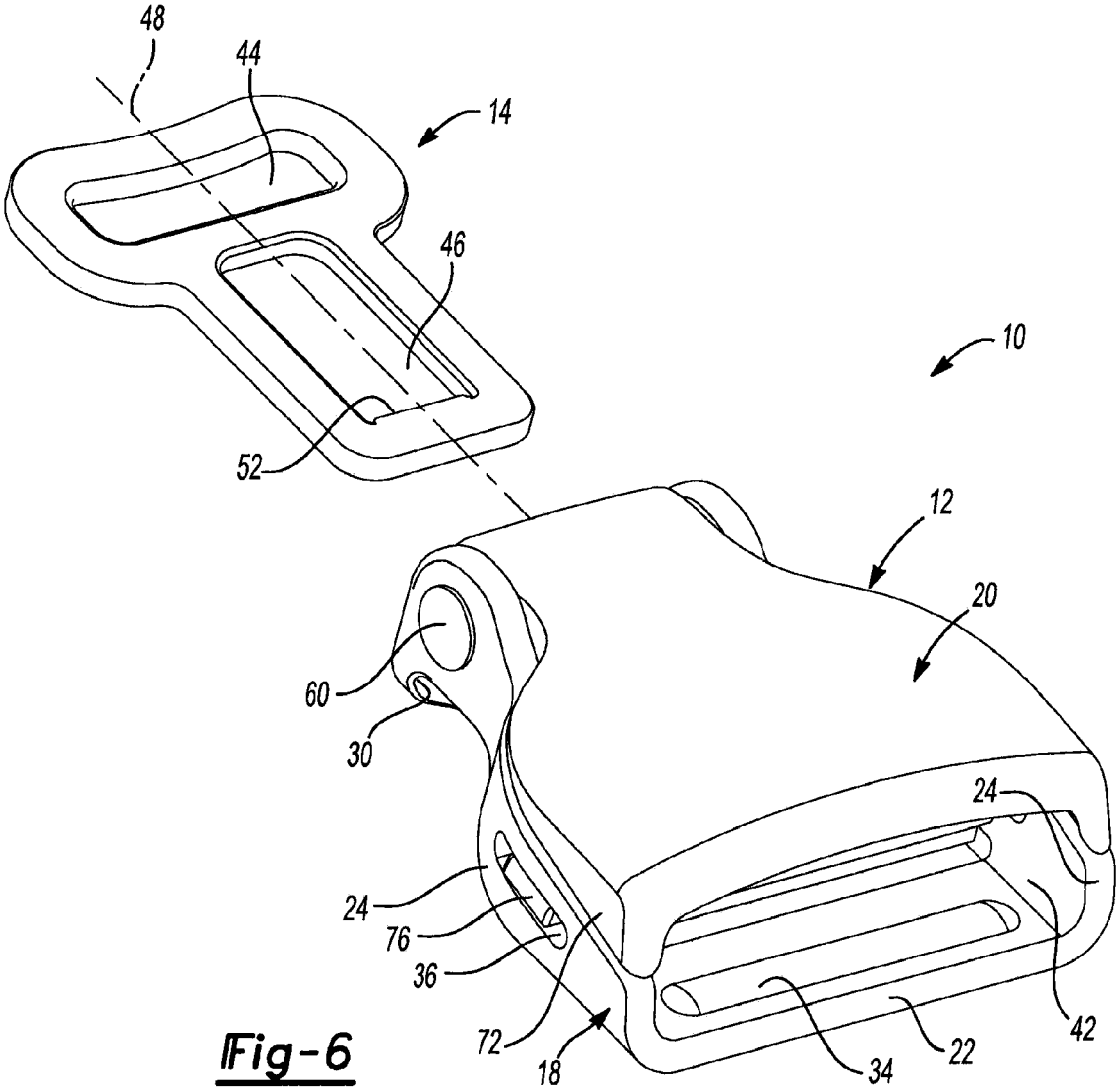
FIG. 6 is a perspective view of the restraint device of FIG. 1 shown in an unlatched state.
Figure 8:
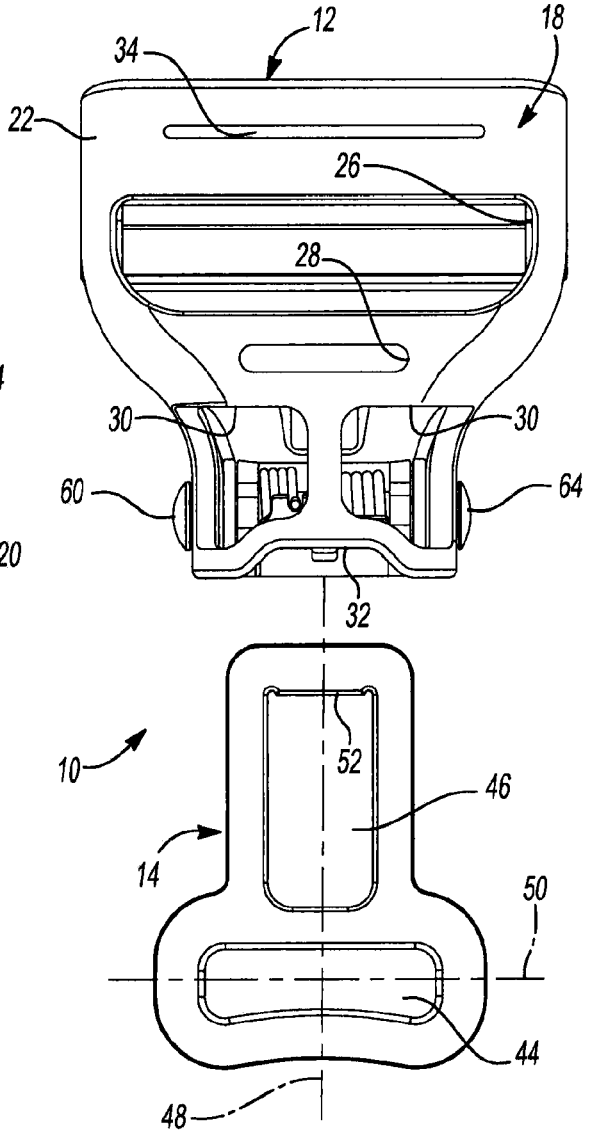
FIG. 8 is a bottom view of the restraint device of FIG. 6.
Figure 9:
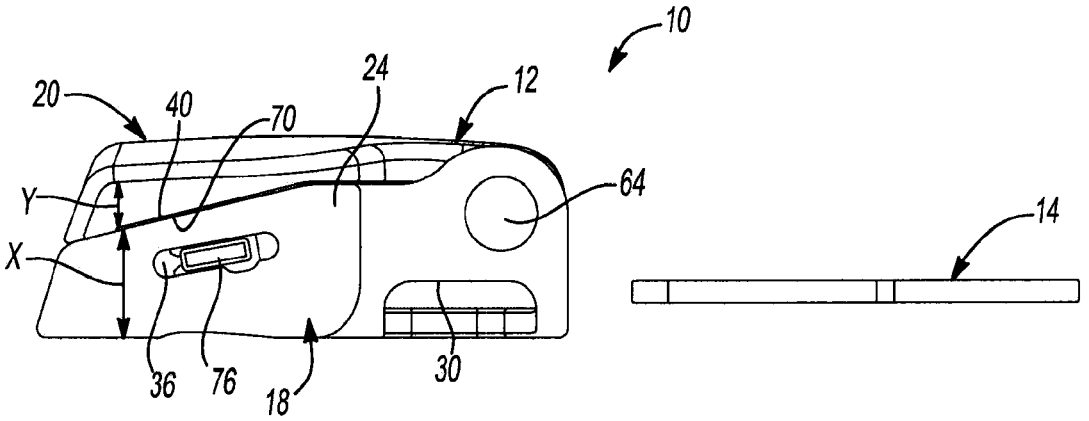
FIG. 9 is a right side view of the restraint device of FIG. 6.
Figure 10:
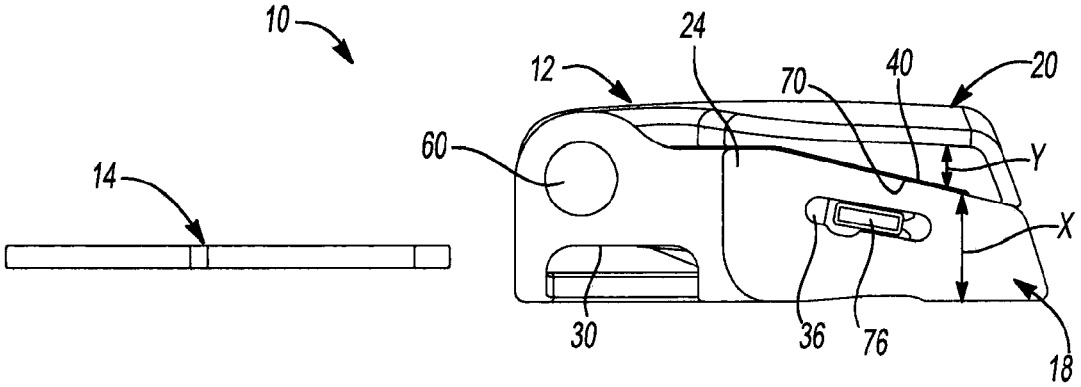
FIG. 10 is a left side view of the restraint device of FIG. 6.

The belt aperture 26 may be formed through the bottom wall 22 of the housing 18 to permit access to the locking mechanism 16. The intermediate aperture 28 may be disposed between the belt aperture 26 and the apertures 30 and may include virtually any shape. For example, the intermediate aperture 28 may include an oval shape, as shown in FIGS. 3 and 8. Regardless of the particular shape of the intermediate aperture 28, the size and shape of the intermediate aperture 28 may be adjusted to provide the housing 18 and, thus, the buckle 12, with a desired rigidity and strength while concurrently providing the buckle 12 with a reduced-weight construction.

The apertures 30 may be disposed proximate to the intermediate aperture 28 and the opening 32 and may extend into each of the side walls 24. As with the intermediate aperture 28, the apertures 30 may include virtually any shape. For example, the size of the apertures 30 and the extent to which the apertures 30 extend into the side walls 24 may adjust the overall strength and rigidity of the housing 18 and, thus, the buckle 12 while concurrently providing the buckle 12 with a reduced-weight construction.

The side walls 24 may extend from the bottom wall 22 such that each side wall 24 is substantially perpendicular to the bottom wall 22. Each side wall 24 may include a slot 36, an attachment aperture 38 (FIG. 12), and a sloped surface 40. The slots 36 may be formed through each side wall 24 and may be disposed between the attachment aperture 38 and an opening 42 of the housing 18. The attachment apertures 38 may likewise be formed through each side wall 24 and may be positioned proximate to the opening 32 of the housing 18. The sloped surface 40 may decrease in a direction extending from the attachment aperture 38 toward the opening 42 to provide the side walls 24 with a substantially constantly decreasing height (X; FIGS. 4, 5, 9, 10) extending in a direction from the attachment aperture 38 toward the opening 42.

Figure 2:
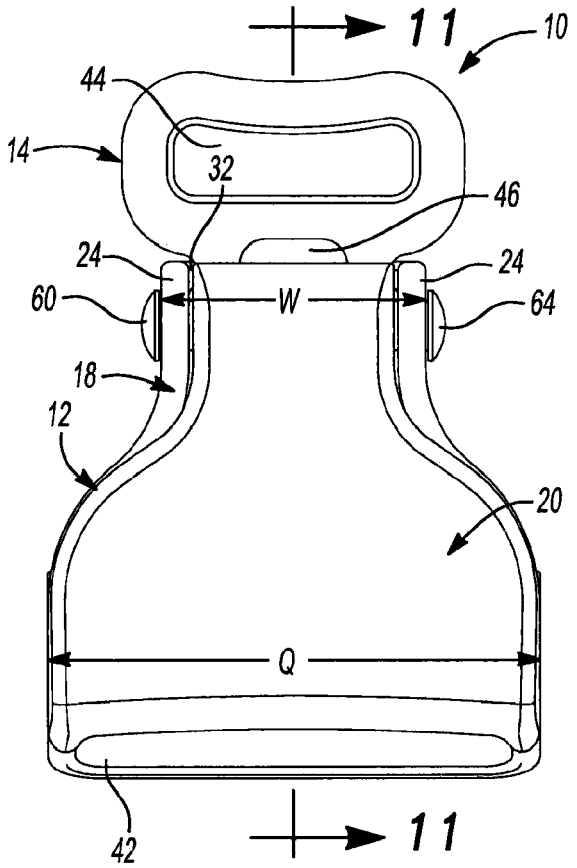
FIG. 2 is a top view of the restraint device of FIG. 1.
Figure 7:
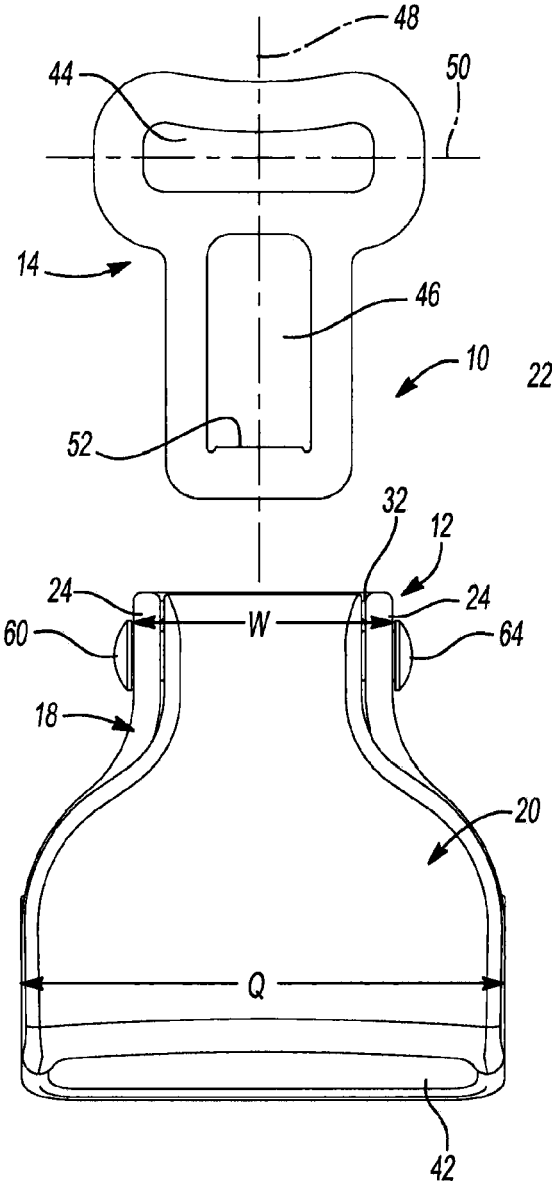
FIG. 7 is a top view of the restraint device of FIG. 6.

The housing 18 may include a reduced width (W) proximate to the opening 32 when compared to the width (Q) of the housing 18 proximate to the opening 42 (FIGS. 2 and 7). For example, the width (W) may be approximately equal to half of the width (Q). The reduction in width proximate to the opening 32 when compared to the opening 42 provides the housing 18 with a compact size which, in turn, reduces the overall weight of the housing 18 and buckle 12. Further, providing the reduced width (W) allows the housing 18 to be properly sized to receive the latch plate 14. While the width (Q) could theoretically be reduced to further reduce the overall weight of the housing 18, the width (Q) of the opening 42 is sized to allow a person's hand to easily enter the opening 42 and grasp the actuation handle 20.

With particular reference to FIGS. 6-12, the latch plate 14 is shown to include a peanut-shaped attachment aperture 44 and a locking aperture 46. The attachment aperture 44 may be formed such that the attachment aperture 44 is substantially perpendicular to a longitudinal axis 48 of the latch plate 14. Namely, a longitudinal axis 50 of the attachment aperture 44 may be substantially perpendicular to the longitudinal axis 48 of the latch plate 14 (FIGS. 7 and 8).

The locking aperture 46 may be formed substantially perpendicular to the attachment aperture 44 such that a longitudinal axis of the locking aperture 46 is parallel to the longitudinal axis 48 of the latch plate 14. The length of the locking aperture 46 measured in a direction along the longitudinal axis 48 of the latch plate 14 may be greater than a length of the attachment aperture 44 measured in a direction along the longitudinal axis 50 of the attachment aperture 44. The locking aperture 46 may additionally include an engagement surface 52 that is in contact with the locking mechanism 16 when the locking mechanism 16 is in the latched state.

Figure 11:
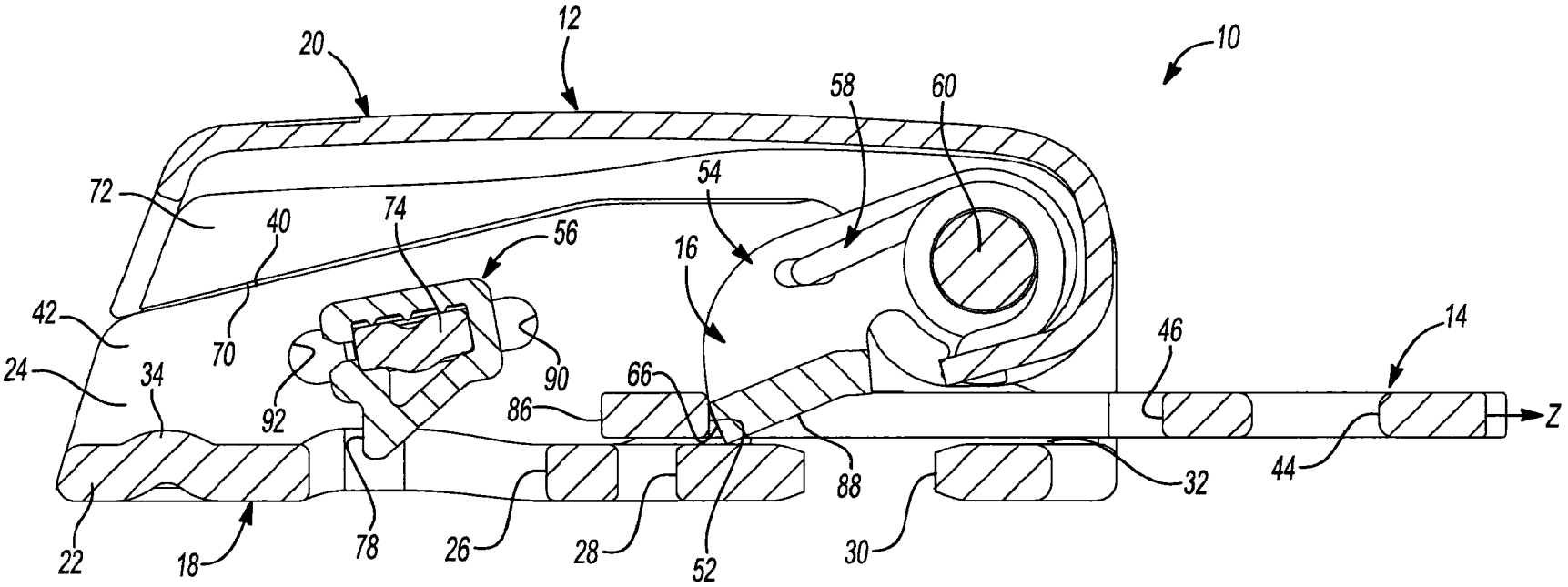
FIG. 11 is a cross-sectional view of the restraint device of FIG. 2 taken along line 11-11.
Figure 12:
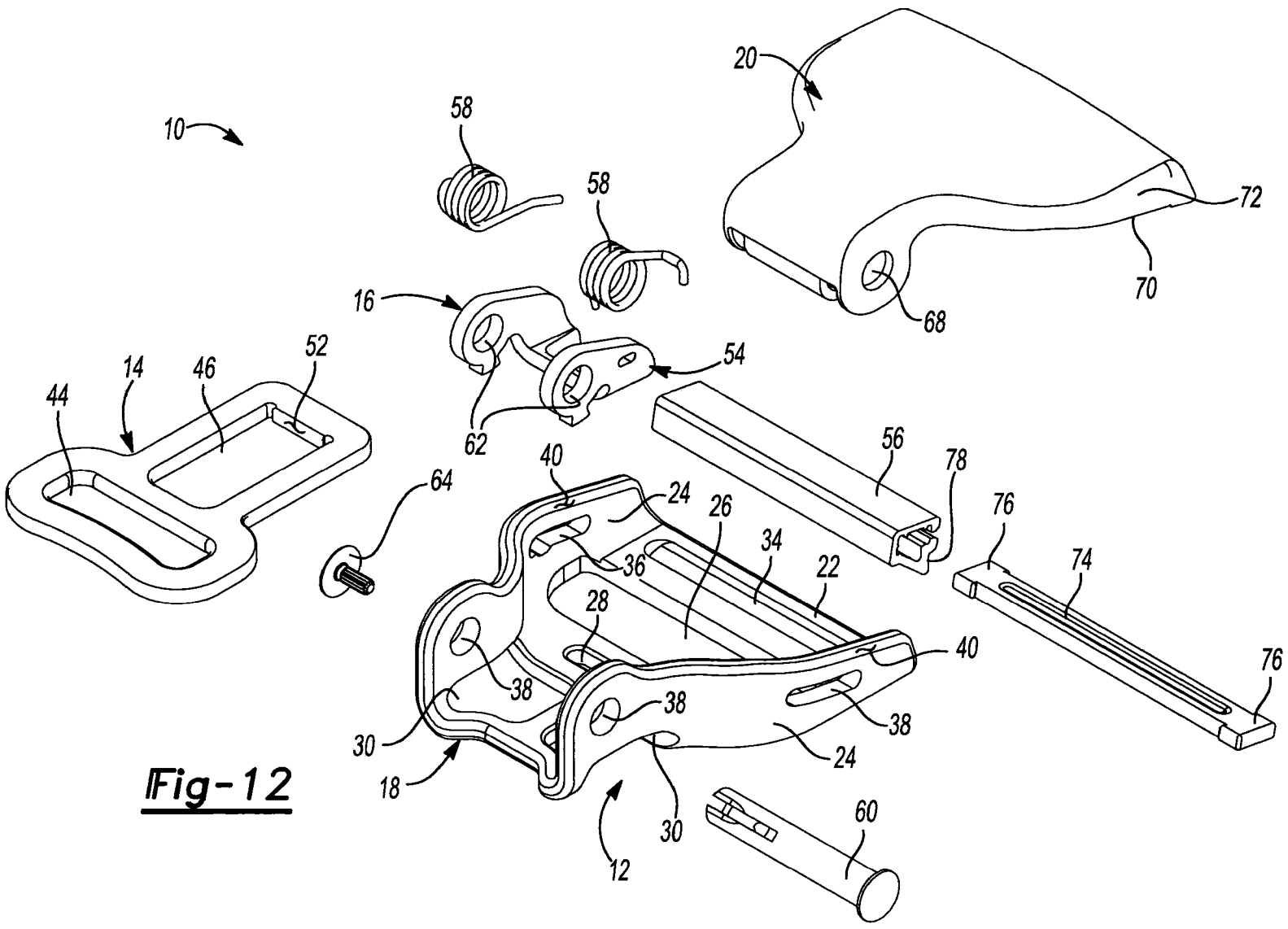
FIG. 12 is an exploded view of the restraint device of FIG. 1.

With particular reference to FIGS. 11 and 12, the locking mechanism 16 is shown to include a latch 54, a locking bar 56, and a pair of biasing elements 58. The latch 54 may be rotatably supported relative to the housing 18 by a pin 60. The pin 60 may be rotatably attached to the housing 18 at the attachment aperture 38 and may likewise be rotatably received by apertures 62 of the latch 54. The pin 60 and, thus, the latch 54, may be held in position relative to the housing 18 by inserting a rivet 64 into the pin 60 once the pin 60 extends through each attachment aperture 38 of the respective side walls 24 and through the apertures 62 of the latch 54. The latch 54 may additionally include an engagement surface 66 (FIG. 11) that contacts the engagement surface 52 of the locking aperture 46 when the latch plate 14 is received within the buckle 12 and the locking mechanism 16 is in the latched state.

The biasing elements 58 may likewise be supported relative to the housing 18 by the pin 60 and may rotatably bias the latch 54 into the latched state (FIG. 11). Namely, the biasing elements 58 may exert a rotational force on the latch 54 to bias the latch 54 in the counterclockwise direction relative to the view shown in FIG. 11.

The actuation handle 20 may likewise be rotatably supported relative to the housing 18 by the pin 60 and may cooperate with the latch 54 to move the locking mechanism 16 from the latched state (FIG. 11) to the unlatched state. Namely, the actuation handle 20 may include a pair of apertures 68 that rotatably receive the pin 60 therein. The actuation handle 20 may therefore be rotatably supported relative to the housing 18 by the pin 60 and may rotate relative to the housing 18 about the pin 60.

The actuation handle 20 may include a generally sloping surface 70 that provides the actuation handle 20 with side walls 72 having a substantially constantly increasing height (Y) extending in a direction from the apertures 68 toward the opening 42 of the housing 18. In one configuration, the sloped surfaces 40 of the housing 18 include a substantially similar slope as the sloped surfaces 70 of the actuation handle 20 such that the sloped surfaces 40 of the housing 18 matingly receive the sloped surfaces 70 of the actuation handle 20. The foregoing configuration of the sloped surfaces 40, 70 allows the side walls 24 of the housing 18 to cooperate with the side walls 72 of the actuation handle 20 to provide the buckle 12 with substantially closed side surfaces when the locking mechanism 16 is in the latched state.

The locking bar 56 may be slidably supported relative to the housing 18 by a slide bar 74. The slide bar 74 may be disposed within the locking bar 56 and may include ends 76 that are respectively and slidably received within the slots 36 of the side walls 24. Permitting the ends 76 of the slide bar 74 to slide within the slots 36 allows the slide bar 74 and, thus, the locking bar 56, to slide relative to the housing 18. The locking bar 56 may additionally include a locking edge 78 that cooperates with the belt aperture 26 to fix a position of a belt (FIGS. 13-15) relative to the buckle 12, as will be described in greater detail below.

Figure 13:
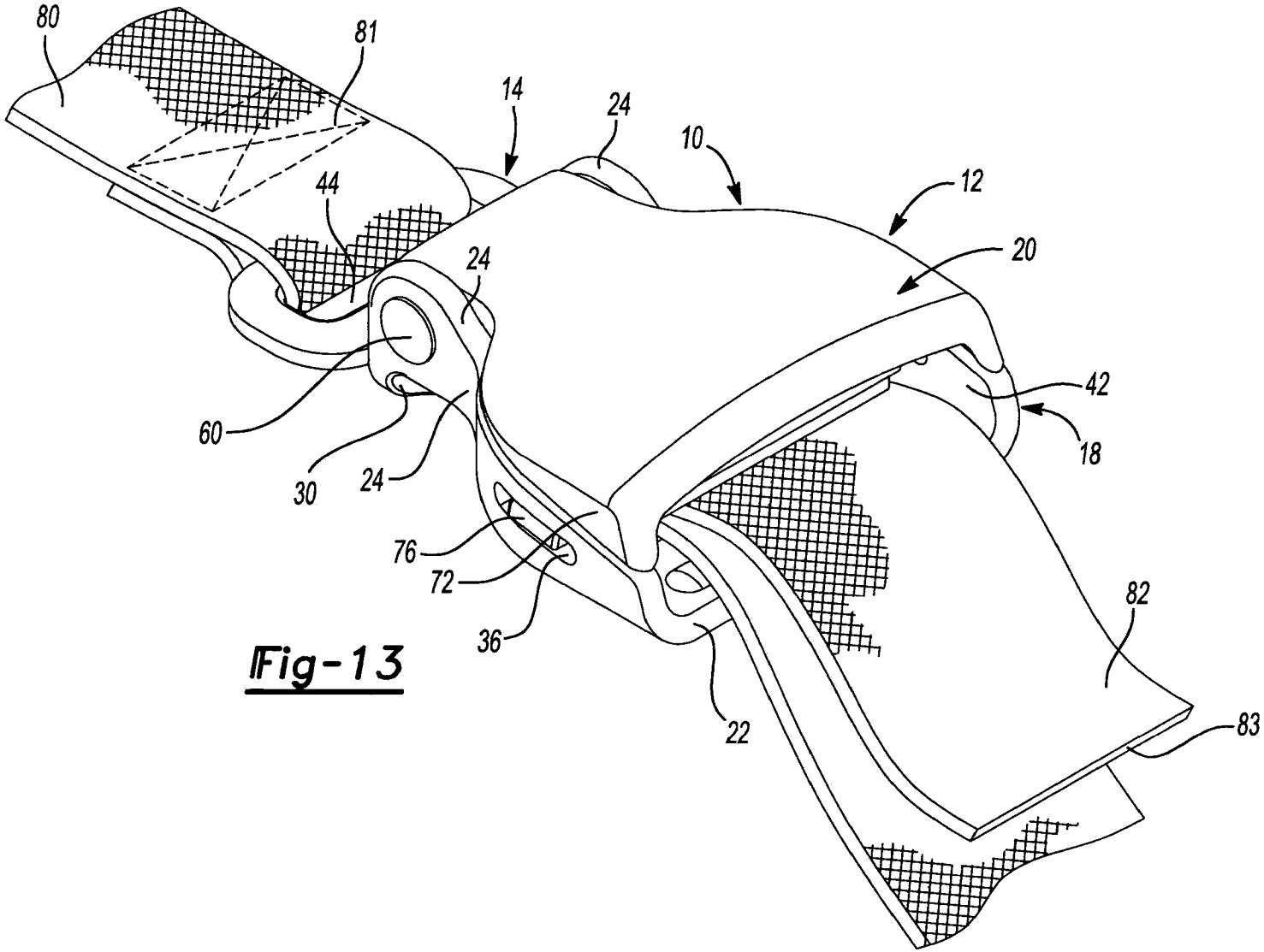
FIG. 13 is a perspective view of the restraint device of FIG. 1 shown in a latched state and in conjunction with a first belt portion and a second belt portion.
Figure 14:
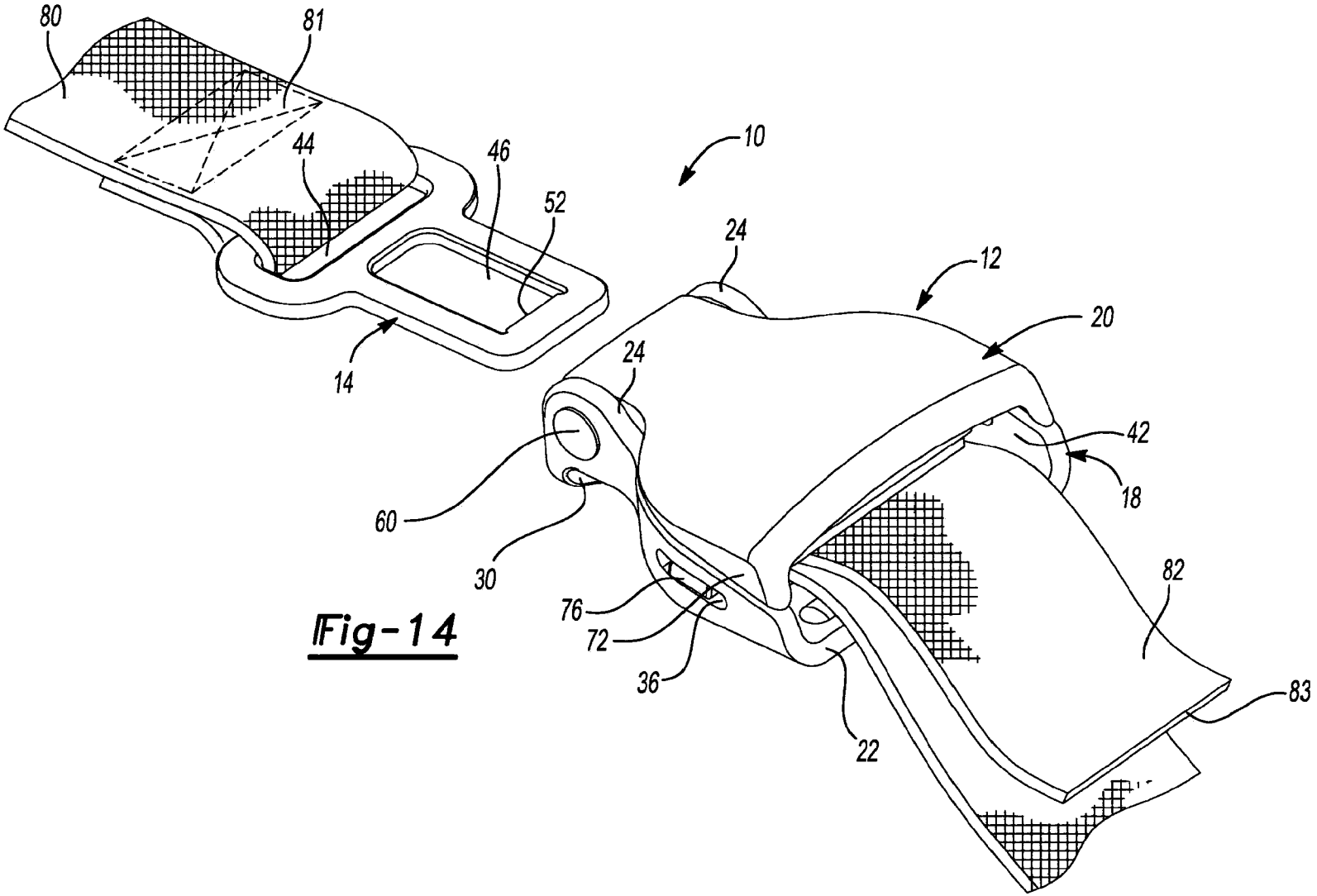
FIG. 14 is a perspective view of the restraint device of FIG. 1 shown in an unlatched state an in conjunction with a first belt portion and a second belt portion.

With particular reference to FIGS. 13 and 14, the restraint device 10 is shown in conjunction with a first belt portion 80 and a second belt portion 82. The first belt portion 80 may be fixedly attached to the latch plate 14 by feeding a portion of the first belt portion 80 through the attachment aperture 44 and subsequently attaching the first belt portion 80 to itself, thereby securing the latch plate 14 to the first belt portion 80. In one configuration, the first belt portion 80 may be fed through the attachment aperture 44 and may be subsequently attached to itself by stitching 81 to restrict removal of the first belt portion 80 from the attachment aperture 44.

The second belt portion 82 may be attached to the buckle 12 by feeding a first end 83 of the second belt portion 82 into the opening 42 of the housing 18 and around an outer perimeter of the locking bar 56. Once the second belt portion 82 surrounds an outer perimeter of the locking bar 56, the first end 83 of the second belt portion 82 may be directed back through the opening 42. In one configuration, the first end 83 of the second belt portion 82 is substantially freely movable relative to the buckle 12 to allow a length of the second belt portion 82 to be adjusted, as will be described in greater detail below.

Figure 15:
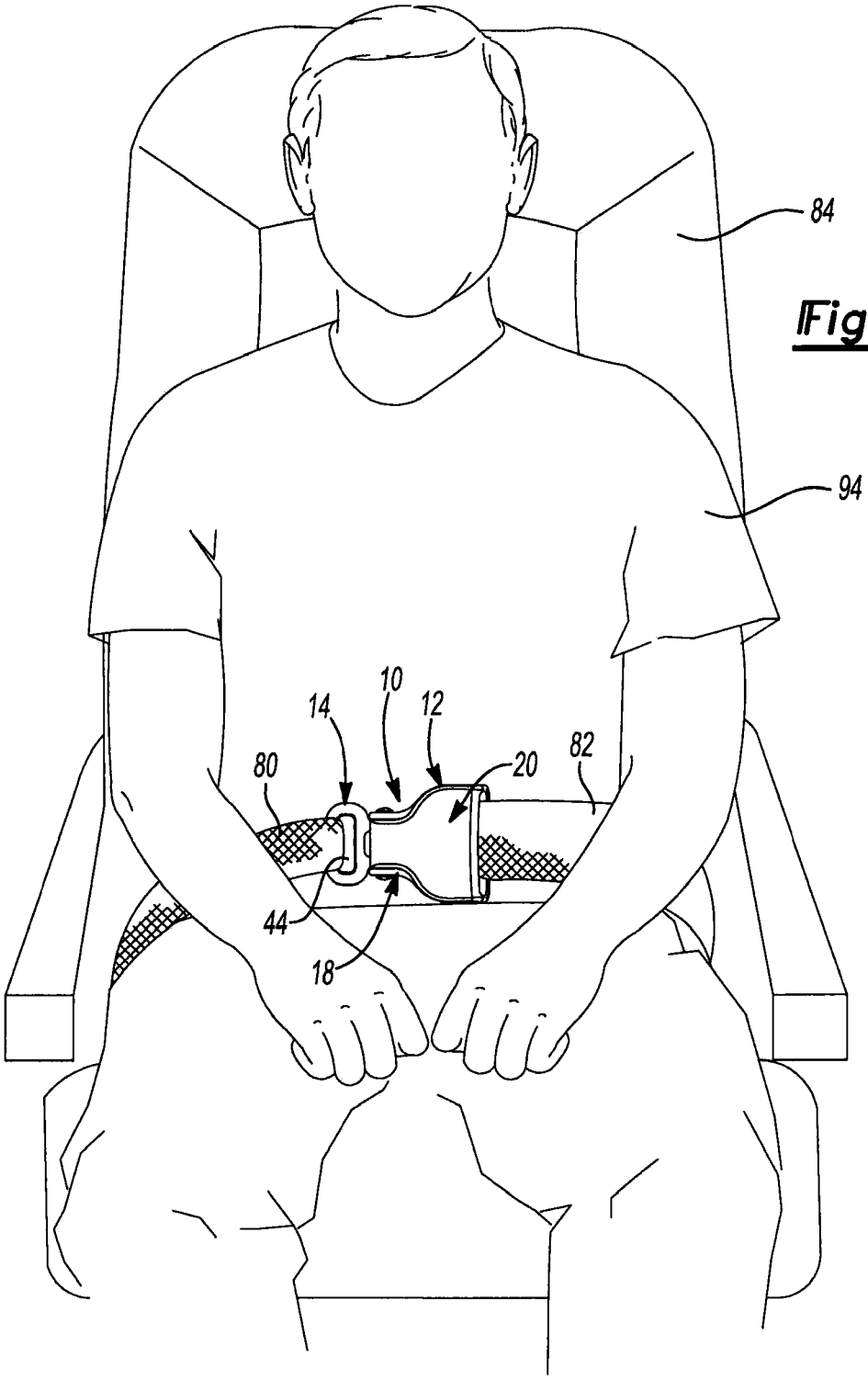
FIG. 15 is a front view of a seat assembly incorporating the restraint device of FIG. 1 in a latched state.

With particular reference to FIG. 15, the restraint device 10 is shown in conjunction with a seat assembly 84. The restraint device 10 may be attached to the seat assembly 84 by attaching the first belt portion 80 and the second belt portion 82 to respective sides of the seat assembly 84. Attaching the first belt portion 80 to the seat assembly 84 and attaching the second belt portion 82 to the seat assembly 84 fixes the first belt portion 80 and the second belt portion 82 for movement with the seat assembly 84 at one end of each belt portion 80, 82. Further, attaching the first belt portion 80 and the second belt portion 82 to the seat assembly 84 in the foregoing manner concurrently allows the belt portions 80, 82 to freely move relative to the seat assembly 84 along a length of each belt portion 80, 82 and at each of the latch plate 14 and buckle 12 when the latch plate 14 is disconnected from the buckle 12.

The respective ends of the first belt portion 80 and the second belt portion 82 associated with the buckle 12 and the latch plate 14 are movable relative to the seat assembly 84 when the latch plate 14 is disconnected from the buckle 12. However, when the latch plate 14 is received within the housing 18 of the buckle 12 and the locking mechanism 16 is in the latched state, the latch plate 14 is fixed for movement with the buckle 12, thereby restricting movement of the first belt portion 80 and the second belt portion 82 relative to the seat assembly 84. Namely, when an occupant 94 is seated in the seat assembly 84 (FIG. 15) and the latch plate 14 is fixed for movement with the buckle 12 due to the locking mechanism 16 being in the latched state and the latch plate 14 being disposed within the buckle 12, the locking mechanism 16 may cooperate with the first belt portion 80 and the second belt portion 82 to restrain the occupant 94 within the seat assembly 84 by preventing removal of the latch plate 14 from the buckle 12.

With particular reference to FIGS. 11-15, operation of the restraint device 10 will be described in detail. When the restraint device 10 is in the unlatched state, the latch plate 14 is disconnected from the buckle 12, thereby allowing the first belt portion 80 and second belt portion 82 to be freely movable relative to one another. When an occupant 94 is seated in the seat assembly 84, the first belt portion 80 and the second belt portion 82 may be positioned relative to the occupant 94 such that the first belt portion 80 and the second belt portion 82 traverse a portion of the occupant 94 proximate to the occupant's lap. At this point, the latch plate 14 may be inserted into the opening 32 of the housing 18 for engagement with the locking mechanism 16.

Upon sufficient insertion of the latch plate 14 into the housing 18, a distal end 86 of the latch plate 14 contacts a sloped surface 88 of the latch 54, thereby causing the latch 54 to rotate in the clockwise direction relative to the view shown in FIG. 11 and against the force exerted on the latch 54 by the biasing elements 58. Rotation of the latch 54 in the clockwise direction relative to the view shown in FIG. 11 allows the distal end 86 of the latch plate 14 to pass by the engagement surface 66 of the latch 54. Once the latch plate 14 is sufficiently moved into the housing 18 such that the locking aperture 46 is disposed beneath the latch 54, the biasing elements 58 are permitted to rotate the latch 54 in the counterclockwise direction relative to the view shown in FIG. 11 to position a portion of the latch 54 within the locking aperture 46, thereby positioning the engagement surface 66 in contact with the engagement surface 52. Contact between the engagement surface 52 of the locking aperture 46 and the engagement surface 66 of the latch 54 restricts movement of the latch plate 14 in the direction (Z) shown in FIG. 11, which likewise prevents removal of the latch plate 14 from the housing 18.

The latch plate 14 may be removed from the housing 18 when a rotational force is applied to the actuation handle 20. Namely, a force may be applied to the actuation handle 20 to rotate the actuation handle 20 in the clockwise direction relative to the view shown in FIG. 11, which likewise causes the latch 54 to rotate in the clockwise direction relative to the view shown in FIG. 11 and against the bias imparted on the latch 54 by the biasing elements 58. Rotation of the latch 54 in the clockwise direction relative to the view shown in FIG. 11 causes the engagement surface 66 of the latch 54 to disengage the engagement surface 52 of the locking aperture 46, thereby permitting movement of the latch plate 14 in the direction (Z). Permitting movement of the latch plate 14 in the direction (Z) allows the latch plate 14 to be removed from the buckle 12, which allows the first belt portion 80 to be moved relative to the second belt portion 82.

Regardless of whether the locking mechanism 16 is in the latched state (FIG. 11) or the unlatched state, the overall length of the first end 83 of the second belt portion 82 may be adjusted by moving the second belt portion 82 relative to and around the outer perimeter of the locking bar 56. Namely, the locking bar 56 may be moved toward a first end 90 of each slot 36 to permit free movement of the second belt portion 82 around the outer perimeter of the locking bar 56. Once the desired length of the first end 83 of the second belt portion 82 is achieved, the locking bar 56 may be moved toward a second end 92 of the slots 36 to pinch or trap the second belt portion 82 between the locking edge 78 and a portion of the bottom wall 22 defining the belt aperture 26.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A restraint system comprising:

a first belt portion having a first end adapted to be secured to the mobile platform and a second end movable relative to the mobile platform;

a second belt portion having a first end adapted to be secured to the mobile platform and a second end movable relative to the mobile platform;

a latch plate fixed to said second end of one of said first belt portion and said second belt portion; and a buckle secured to said second end of the other of said first belt portion and said second belt portion and selectively connected to said latch plate in a latched state to join said first belt portion and said second belt portion, said buckle including a housing having an actuation handle, an opening receiving said latch plate in said latched state, a bottom surface disposed on an opposite side of said housing than said actuation handle, a first aperture formed through said bottom surface of said housing and extending continuously from said bottom surface to a first side surface of said housing, and a second aperture aligned with said first aperture along a longitudinal axis of said housing formed through said bottom surface of said housing and extending continuously from said bottom surface to a second side surface of said housing, said housing further including a connecting member disposed between said first and second apertures and connecting a first portion of said bottom surface adjacent to said opening to a second portion of said bottom surface an opposite side of said first and second apertures than said first portion.

2. The restraint system of claim 1, wherein said first side surface and said second side surface are formed substantially perpendicular to said bottom surface of said housing and substantially parallel to one another.

3. The restraint system of claim 1, wherein said first side surface is formed substantially perpendicular to said bottom surface.

4. The restraint system of claim 3, wherein said actuation handle is selectively movable relative to said housing to permit removal of said latch plate from said housing when in said latched state.

5. The restraint system of claim 1, wherein said latch plate includes a locking aperture at least partially received within said housing in said latched state.

6. The restraint system of claim 5, wherein said locking aperture of said latch plate includes a longitudinal axis that extends along a longitudinal axis of said one of said first belt portion and said second belt portion.

7. The restraint system of claim 1, wherein said housing includes a first section at said opening and a second section adjacent to an end of said housing opposite said opening, said first section having a first width between said first and second side surfaces that is less than a second width of said second section between said first and second side surfaces.

8. The restraint system of claim 1, wherein said housing includes a latch mechanism operable to engage said latch plate in said latched state.

9. A restraint system comprising:

a first belt portion having a first end adapted to be secured to the mobile platform and a second end movable relative to the mobile platform;

a second belt portion having a first end adapted to be secured to the mobile platform and a second end movable relative to the mobile platform;

a buckle secured to said second end of one of said first belt portion and said second belt portion and including a latch mechanism movable between a latched state and an unlatched state, and a housing having a first aperture formed through a bottom surface of said housing and extending continuously from said bottom surface to a first side surface of said housing that is substantially perpendicular to said bottom surface, and a second aperture aligned with said first aperture along a longitudinal axis of said housing formed through said bottom surface of said housing and extending continuously from said bottom surface to a second side surface of said housing, said housing further including a connecting member disposed between said first and second apertures and connecting a first or portion of said bottom surface adjacent to said opening to a second portion of said bottom surface an opposite side of said first and second apertures than said first portion; and a latch plate fixed to said second end of the other of said first belt portion and said second belt portion and selectively received within an opening of said buckle in said latched state to join said first belt portion and said second belt portion.

10. The restraint system of claim 9, wherein said housing includes an actuation handle operable to move said latch mechanism from said latched state to said unlatched state, said bottom surface of said buckle being formed on an opposite side of said housing than said actuation handle.

11. The restraint system of claim 9, wherein said first side surface and said second side surface are both substantially perpendicular to said bottom surface.

12. The restraint system of claim 9, wherein said first side surface and said second side surface oppose one another.

13. The restraint system of claim 9, wherein said buckle includes a first section at said opening and a second section adjacent to an end of said housing opposite said opening, said first section having a first width between said first and second side surfaces that is less than a second width of said second section between said first and second side surfaces.

14. The restraint system of claim 9, wherein said latch plate includes a locking aperture that engages said latch mechanism in said latched state and has a longitudinal axis that is parallel to a longitudinal axis of said latch plate.

15. The restraint system of claim 14, wherein said latch plate includes an attachment aperture that receives said second end of said other of said first belt portion and said second belt portion, said attachment aperture including a longitudinal axis that is substantially perpendicular to said longitudinal axis of said locking aperture, said attachment aperture being shorter than said locking aperture.

16. A buckle for a restraint system having a first belt portion and a second belt portion and a latch, the restraint system comprising:

a buckle secured to said second end of the other of said first belt portion and said second belt portion and selectively connected to said latch plate in a latched state to join said first belt portion and said second belt portion, said buckle including a housing having an actuation handle, an opening receiving said latch plate in said latched state, a bottom surface disposed on an opposite side of said housing than said actuation handle, a first aperture formed through said bottom surface of said housing and extending continuously from said bottom surface to a first side surface of said housing, and a second aperture aligned with said first aperture along a longitudinal axis of said housing formed through said bottom surface of said housing and extending continuously from said bottom surface to a second side surface of said housing, said housing further including a connecting member disposed between said first and second apertures and connecting a first portion of said bottom surface adjacent to said opening to a second portion of said bottom surface an opposite side of said first and second apertures than said first portion.

* * * * *